US008616178B2

(12) United States Patent
Palumbo

(10) Patent No.: US 8,616,178 B2
(45) Date of Patent: Dec. 31, 2013

(54) ENGINE BRAKING SYSTEM USING SPRING LOADED VALVE

(75) Inventor: Christofer J. Palumbo, Elmwood Park, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 0 days.

(21) Appl. No.: 13/641,696

(22) PCT Filed: Apr. 16, 2010

(86) PCT No.: PCT/US2010/031418

§ 371 (c)(1),
(2), (4) Date: Feb. 28, 2013

(87) PCT Pub. No.: WO2011/129836

PCT Pub. Date: Oct. 20, 2011

(65) Prior Publication Data

US 2013/0206103 A1 Aug. 15, 2013

(51) Int. Cl.
*F02D 9/06* (2006.01)

(52) U.S. Cl.
USPC ..... 123/323; 123/320

(58) Field of Classification Search
USPC ..... 123/320, 323, 324
See application file for complete search history.

(56) References Cited

U.S. PATENT DOCUMENTS

| | | | | |
|---|---|---|---|---|
| 3,889,646 | A * | 6/1975 | Harper et al. | 123/48 D |
| 5,615,646 | A * | 4/1997 | Feucht | 123/90.12 |
| 5,682,848 | A * | 11/1997 | Hampton et al. | 123/90.16 |
| 6,109,027 | A * | 8/2000 | Schaefer | 60/324 |
| 6,179,096 | B1 * | 1/2001 | Kinerson et al. | 188/154 |
| 6,216,667 | B1 * | 4/2001 | Pekar | 123/320 |
| 6,708,655 | B2 * | 3/2004 | Maloney et al. | 123/48 A |
| 6,981,519 | B2 * | 1/2006 | Heckt et al. | 137/599.18 |
| 7,735,466 | B1 * | 6/2010 | Moore et al. | 123/323 |
| 2006/0107922 | A1 * | 5/2006 | Meistrick et al. | 123/323 |
| 2007/0272505 | A1 * | 11/2007 | Lhote et al. | 188/273 |
| 2009/0044778 | A1 * | 2/2009 | Scuderi et al. | 123/188.2 |
| 2011/0126800 | A1 * | 6/2011 | Song et al. | 123/323 |

* cited by examiner

*Primary Examiner* — Erick Solis
(74) *Attorney, Agent, or Firm* — Jeffrey P. Calfa; Mark C. Bach

(57) ABSTRACT

An engine braking system includes an exhaust control path between an engine cylinder and an exhaust discharge path. A relief valve has a valve element located within the path, the valve element operable between a closed position to close the exhaust control path, corresponding to an engine operating condition, and an open position to open the exhaust control path, corresponding to an engine-braking condition. A spring urges the valve element toward the closed position. A retainer is arranged to be positioned in two operating positions, a first operating position which prevents opening of the valve element and a second operating position which allows opening of the valve element. An actuator wedge is operable to move between a first position and a second position to move the retainer between the first and second operating positions.

17 Claims, 3 Drawing Sheets

ENGINE BRAKING SYSTEM USING SPRING LOADED VALVE

TECHNICAL FIELD

This disclosure relates to vehicles, particularly large tractor trailer trucks, including but not limited to apparatus, control and operation for engine braking.

BACKGROUND

Adequate and reliable braking for vehicles, particularly for large tractor-trailer trucks, is desirable. While drum or disc wheel brakes are capable of absorbing a large amount of energy over a short period of time, the absorbed energy is transformed into heat in the braking mechanism.

Braking systems are known which include exhaust brakes which inhibit the flow of exhaust gases through the exhaust system, and compression release systems wherein the energy required to compress the intake air during the compression stroke of the engine is dissipated by exhausting the compressed air through the exhaust system.

In order to achieve a high engine-braking action, a brake valve in the exhaust line may be closed during braking, and excess pressure is built up in the exhaust line upstream of the brake valve. For turbocharged engines, the built-up exhaust gas flows at high velocity into the turbine of the turbocharger and acts on the turbine rotor, whereupon the driven compressor increases pressure in the air intake duct. The cylinders are subjected to an increased charging pressure. In the exhaust system, an excess pressure develops between the cylinder outlet and the brake valve and counteracts the discharge of the air compressed in the cylinder into the exhaust tract via the exhaust valves. During braking, the piston performs compression work against the high excess pressure in the exhaust tract, with the result that a strong braking action is achieved.

Another engine braking method, as disclosed in U.S. Pat. No. 4,395,884, includes employing a turbocharged engine equipped with a double entry turbine and a compression release engine retarder in combination with a diverter valve. During engine braking, the diverter valve directs the flow of gas through one scroll of the divided volute of the turbine. When engine braking is employed, the turbine speed is increased, and the inlet manifold pressure is also increased, thereby increasing braking horsepower developed by the engine.

Other methods employ a variable geometry turbocharger (VGT). When engine braking is commanded, the variable geometry turbocharger is "clamped down" which means the turbine vanes are closed and used to generate both high exhaust manifold pressure and high turbine speeds and high turbocharger compressor speeds. Increasing the turbocharger compressor speed in turn increases the engine airflow and available engine brake power. The method disclosed in U.S. Pat. No. 6,594,996 includes controlling the geometry of the turbocharger turbine for engine braking as a function of engine speed and pressure (exhaust or intake, preferably exhaust).

In compression-release engine brakes, there is an exhaust valve event for engine braking operation. For example, in the "Jake" brake, such as disclosed in U.S. Pat. Nos. 4,423,712; 4,485,780; 4,706,625 and 4,572,114, during braking, a braking exhaust valve is closed during the compression stroke to accumulate the air mass in engine cylinders and is then opened at a selected valve timing somewhere before the top-dead-center (TDC) to suddenly release the in-cylinder pressure to produce negative shaft power or retarding power.

In "Bleeder" brake systems, during engine braking, a braking exhaust valve is held constantly open during the entire engine cycle to generate a compression-release effect.

According to the "EVBec" engine braking system of Man Nutzfahrzeuge AG, there is an exhaust secondary valve lift event induced by high exhaust manifold pressure pulses during intake stroke or compression stroke. The secondary lift profile is generated in each engine cycle and it can be designed to last long enough to pass TDC and high enough near TDC to generate the compression-release braking effect. Such a system is described for example in U.S. Pat. No. 4,981,119.

The present inventor has recognized the desirability of an alternate design solution that would deliver improved engine braking at a reduced cost.

SUMMARY

Engine braking can be improved for relatively low cost with the addition of a spring loaded valve or pressure relief valve in at least one cylinder of the engine. When the piston compresses the air in the combustion chamber, the relief valve will open at a predetermined pressure to correspond to a peak pressure associated with the engine compression ratio. Thus, the crankshaft puts power into compressing air, the valve releases this pressure, and the energy of compression is lost, thus generating the braking force.

According to one exemplary embodiment, the engine braking system includes an exhaust control path between an engine cylinder and an exhaust discharge path. A valve element is located within the path, the valve element operable between a closed position to close the exhaust control path and an open position to open the exhaust control path. A spring urges the valve element toward the closed position. A key or retainer is arranged to be positioned in two operating positions, a first operating position which prevents opening of the valve element and a second operating position which allows opening of the valve element. A wedge is operable to move between a first position and a second position to move the key between the first and second operating positions.

The key can be mounted to pivot between the first and second operating positions. The key can be urged by a spring toward the first operating position. The key can have a first inclined surface and the wedge has a second inclined surface, wherein when the wedge is moved from the first position to the second position, the second inclined surface slides on the first inclined surface.

According to one aspect, the at least one face comprises a first surface having a first surface area subject to cylinder pressure when the valve element is in the closed position, and the valve element comprises a second surface set back from the first surface and having a greater surface area than the first surface area, the second surface subject to cylinder pressure when the valve moves toward the open position. The valve element can include a valve spindle, an end of which forms the first surface. The valve spindle can be contiguous with a valve piston. The valve piston is slidable within the exhaust control path and forms the second surface. The spindle end closes a first valve seat when the valve element is in the closed position, and the piston opens an entry to the exhaust discharge path from the exhaust control path as the valve element moves toward the open position. The valve element configuration thus provides two valve openings, a first opening between the spindle and the first valve seat and a second opening between the valve piston and the entry between the control path and the discharge path.

One advantage of this braking system over a traditional compression brake is noise abatement. Traditional compression brakes open up a large valve against high pressure which creates an audible 'pop' each time. This valve element of the exemplary embodiment will generate a significant braking force, but the routing of gas from the valve back to the exhaust will dampen this audible 'pop' substantially, which will allow the use of this braking system in noise restricted areas.

Numerous other advantages and features of the present invention will be become readily apparent from the following detailed description of the invention and the embodiments thereof, from the claims and from the accompanying drawings.

DETAILED DESCRIPTION

Figure 1:
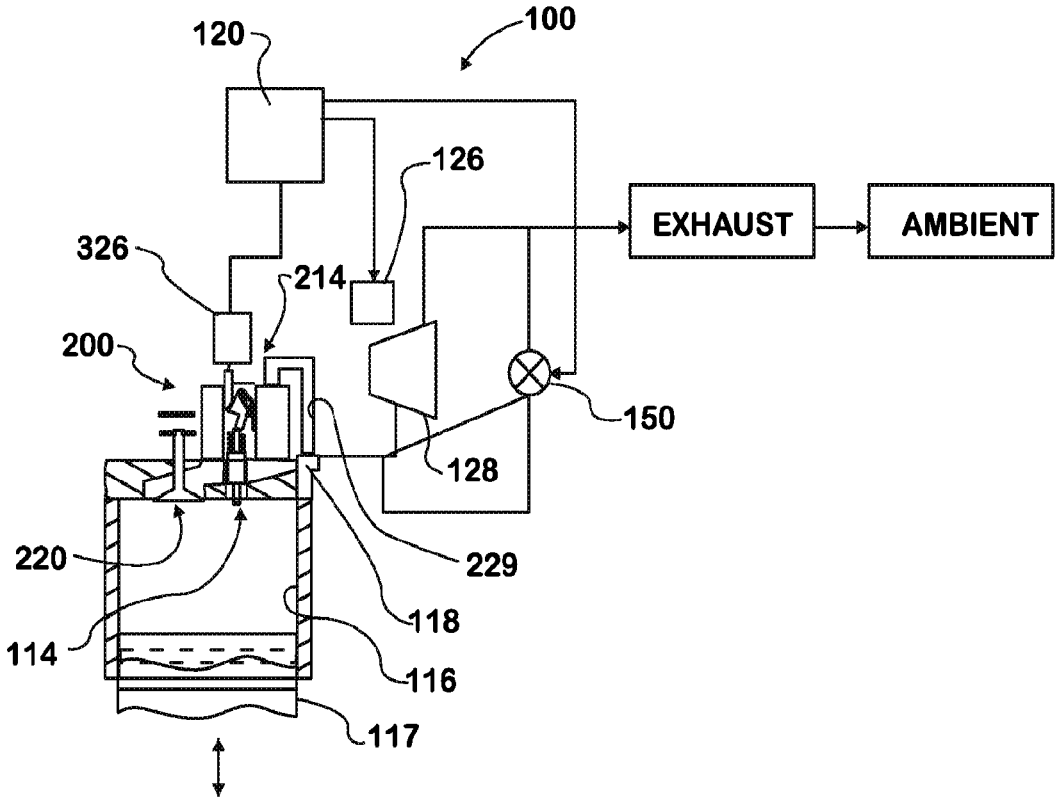
FIG. 1 is a schematic system diagram of the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a simplified schematic of an engine braking control system 100. Although the system is shown applied to one cylinder of an engine, more than one cylinder or all cylinders of an engine can be configured identically to the cylinder shown. The system acts on a spring loaded braking valve 114 that opens a cylinder 116 to an exhaust manifold 118 as shown enlarged in FIG. 2. A piston 117, operatively connected to an engine crankshaft (not shown), reciprocates within the cylinder 116. An engine braking controller 120, such as a microprocessor or other electronic control, responsive to an engine braking command by the vehicle operator or to an otherwise generated braking signal, can be signal-connected to a control actuator 126 of a variable geometry turbocharger turbine 128 having one or more stages. The turbine 128 drives one or more stages of an intake air compressor (not shown) that charges pressurized air into the intake manifold of the engine. The engine braking control 120 can also be connected to one or more wastegates or turbine bypasses 150. As an alternative to the variable geometry turbocharger, a conventional, non-variable geometry turbocharger can be provided.

Figure 2:
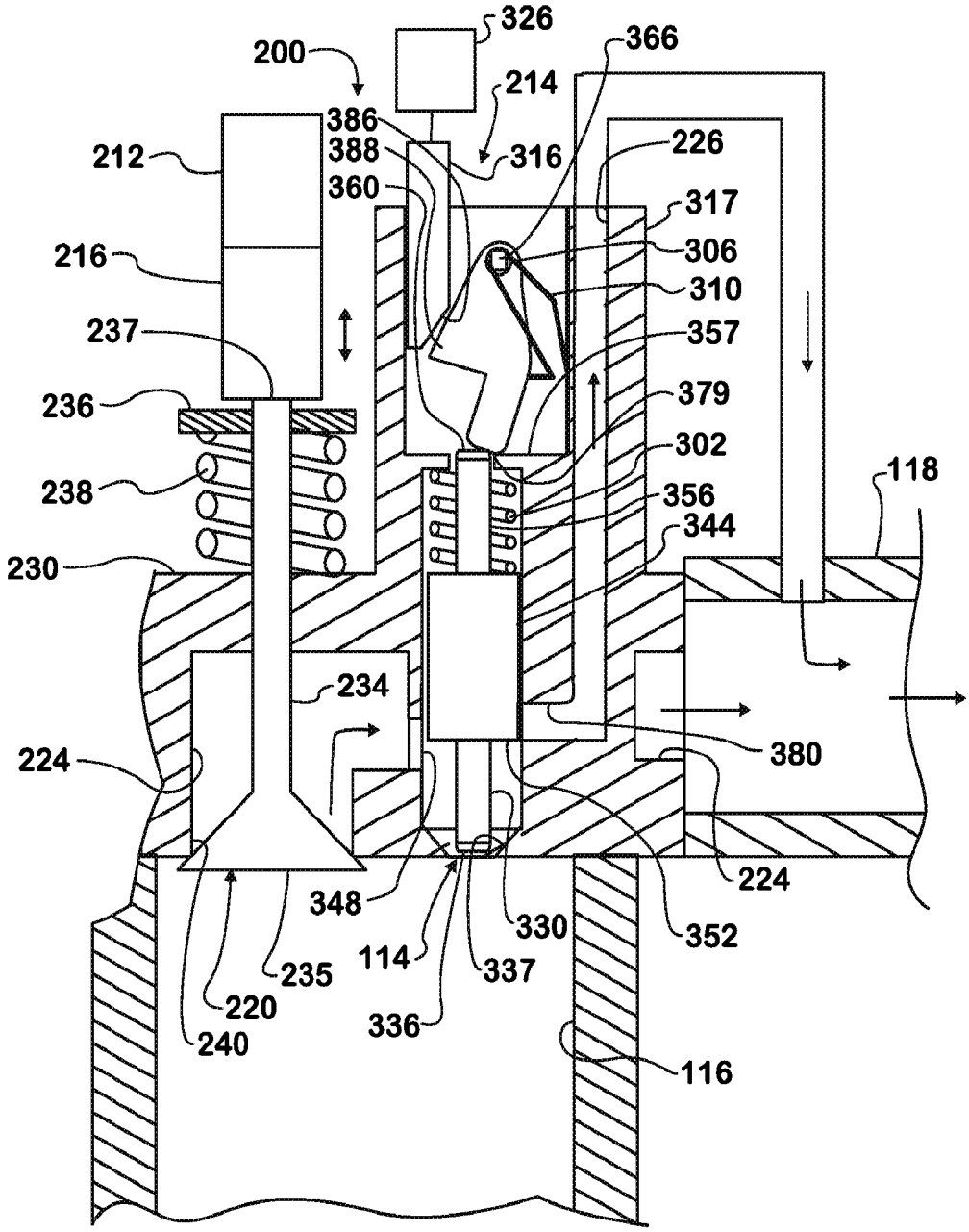
FIG. 2 is a schematic sectional view of an engine braking system according to the invention with the system operating in a non-braking mode.

FIG. 2 shows an exemplary exhaust valve control system 200 used in engine braking operation. Identical devices can be used at all cylinders or some of the cylinders, of the engine, although only the system 200 at the cylinder 116 is shown. The system 200 includes a rocker arm 212, a valve bridge 216, a braking valve control 214 an operating exhaust valve 220 and the braking valve 114. The valve bridge is used when two operating exhaust valves 220 (only one shown) are operated in tandem, i.e., both open and close together, during normal operation. If only one operating exhaust valve 220 is used, the bridge can be eliminated and the rocker arm 212 can act directly on the operating exhaust valve end. The valves 220 and 114 open the cylinder 116 to the exhaust manifold 118 via exhaust gas passages 224, 226 provided in a cylinder head 230. Although the gas passage 226 is shown as a separate passage from the braking valve 114 to the manifold 118, it could also be a shorter passage wherein the passage 226 is open into the path 224 within the head 230.

Each operating exhaust valve 220 includes a stem 234 having a stem end 237, a head 235, and a spring keeper 236. A valve spring 238 surrounds the stem 234 and is fit between the keeper 236 and the cylinder head 230. To move the head 235 away from valve seat 240 during normal engine operation, at the selected crankshaft angle, the rocker arm 212 presses the valve bridge 216 down to move the valve stem 234 down via force on the end 237 against the expansion force of the spring 238 as the spring is being compressed between the keeper 236 and the cylinder head 230, and against the cylinder pressure force on the valve 220.

The braking control 214 includes the braking valve 114, a valve spring 302, a valve key or retainer 306, a valve retainer spring 310, an actuator wedge 316, and an actuator 326. The braking control 214 is substantially held within and supported by a housing portion 317.

The braking valve 114 includes a valve spindle 330 with a valve head 336 formed as a beveled tip portion of the spindle 330. The valve head 336 is configured to close a valve seat 337 formed on the head 230. The valve seat angle should be shallow to avoid sticking. The spindle 330 is formed with, or attached to, a valve piston 344. The piston 344 slides within a valve cylinder 348, and includes a piston face 352. A valve stem 356 is attached to, or formed with, the piston 344, opposite to the spindle 330. The stem 356 includes a stem end 360 that is exposed outside a cylinder 348 through a hole in a top wall 357 thereof. The valve spring 302 surrounds the stem 356 and is fit within the cylinder 348 between the top wall 357 and the piston 344.

Figure 3:
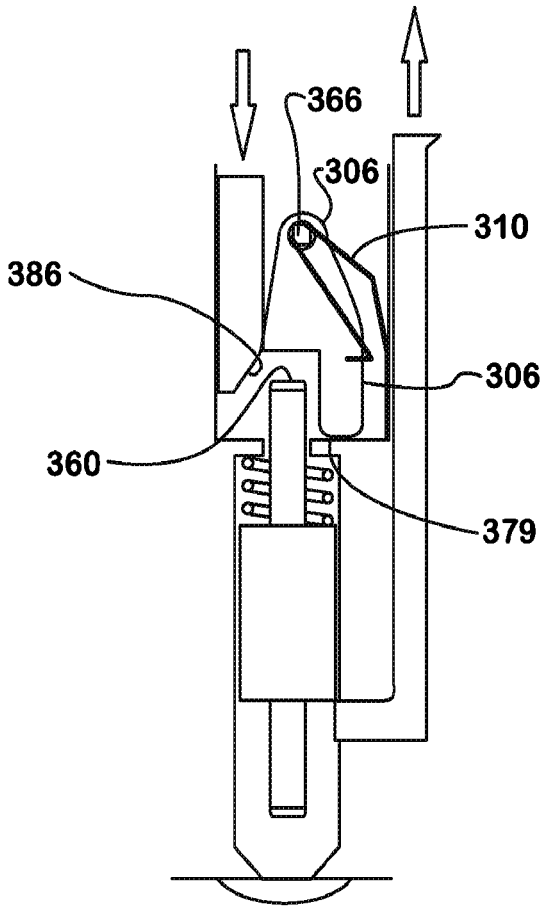
FIG. 3 is a schematic sectional view similar to FIG. 1 but with the system operating in a braking mode.

The retainer 306 is mounted on a pivot pin 366 to the head 230 and can be pivoted about the pin 366 into alternate position shown in FIG. 2 and FIG. 3. The position shown in FIG. 2 corresponds to a non-engine braking condition and the position shown in FIG. 3 corresponds to an engine braking condition.

Both the retainer 306 and braking valve 114 should be hardened material.

As shown in FIG. 2, the actuator 326 has caused the actuator wedge 316 to be elevated. Accordingly, the spring 310, which as shown is a torsion spring, urges the retainer 306 clockwise to the position wherein the retainer overlies the end 360 of the stem 356. The retainer 306 has a bottom surface 379 shaped to have a cam action so the retainer 306 wedges the braking valve 114 closed when not needed.

The braking valve 114 is thus held down in a closed position. The valve head 336 closes the valve seat 337 and the piston 344 closes an entry 380 of the exhaust path 226. The valve cylinder 348 forms an exhaust control path between the valve seat 337 and the entry 380. The valve 114 and the retainer 306 should hold closed against cylinder combustion pressures of about 3000 psi.

When the actuator 326 drives the actuator wedge 316 down, a first oblique surface 386 on the wedge slides over a second oblique surface 388 on the retainer 306 to force the retainer to rotate counterclockwise from the position shown in FIG. 2 to the position shown in FIG. 3, against the urging of the spring 310.

With the retainer 306 in the position of FIG. 3, the retainer bottom surface 379 clears the end 360 of the braking valve 114. The pressure within the cylinder 116 is sufficient to displace the head 336 from the seat 337 and the pressure on the face 352 further moves the piston upward to progressively expose the entry 380 to the cylinder gas.

Although a wedge device is shown, other actuator types can be used to effect the locked and unlocked positions of the spring loaded device. The actuator 326 can be solenoid operated or operated by oil pressure.

Sufficient delay is required to keep the valve open long enough to evacuate the combustion chamber as the pressure decreases. This decreased pressure should be 50-100 psi. Opening pressure should be around 750 psi. These opening and closing pressure actuations are achieved by having two different diameters on the valve, the first diameter of the valve head 336 and the second diameter of the piston 344.

The size of the first diameter must be big enough to evacuate the compressed air at the highest desired operating speed. When the valve opens, air impinges on the second diameter to keep the valve open until about 150 psi is reached. Total valve actuation motion and valve weight should be minimized to reduce kinetic forces. Valve motion in the figures is exaggerated for explanation purposes.

As an example, for an inline-6 cylinder, 570 cubic inch engine, with a maximum braking speed of 2500 RPM and a compression ratio of 17:1, the opening diameter at the valve seat 337 should be about 11 mm or 0.44 inches or greater. With this opening, the spring force should be 110 lbs to open at top dead center. The diameter of the valve piston 344 should be about 25 mm, or one inch or greater.

Bore fit between the larger bore diameter and the housing should seal enough for good actuation. Either tight tolerances or an O-ring can be used. An O-ring may require grease and tight bore tolerances may require oil.

The valve spring 302 should be a dual spring to avoid resonance issues which are typical during high engine speeds. An alternative to a dual spring is a shaped spring that rubs against the body, and this will require hardened materials of the spring and body, and will require more development testing.

The actuator will be part of the valve assembly if it is a solenoid, but will be part of the high pressure oil rail if it is hydraulic.

The housing portion 317 can be partially integrated into the cylinder head 230 or it can be a self contained unit fastened to the cylinder head or otherwise supported on the engine. If desired, braking valves 114 for each engine cylinder can be actuated for braking, or less than all of the braking valves 114 can be actuated to modulate the amount of braking force desired.

Referring to FIG. 1, for an enhancement to the braking effect of the valves 114, the braking control 120 can cause the actuator 126 of the variable geometry turbine 128 to clamp down the variable geometry turbine to increase turbine speed and thus increase compressor speed and air into the engine. Also, the braking control 120 can close any wastegate 150 to also increase the turbine speed by increasing exhaust gas flow through the turbine to increase air into the engine from the compressor.

PARTS LIST

100 engine braking control system
114 spring loaded braking valve
116 cylinder
117 piston
118 exhaust manifold
120 engine braking control
126 turbine control actuator
128 variable geometry turbocharger turbine
150 turbine wastegate
200 engine exhaust valve control system
212 rocker arm
214 braking valve control
216 valve bridge
220 operating exhaust valve
224 exhaust gas passage
226 exhaust gas passage
230 cylinder head
234 valve stem
235 valve head
236 spring keeper
237 stem end
238 valve spring
240 valve seat
302 valve spring
306 key or retainer
310 valve retainer spring
316 actuator wedge
317 housing portion
326 actuator
330 valve spindle
336 valve head
337 valve seat
344 valve piston
348 valve cylinder
352 piston face
357 valve stem
360 stem end
366 pivot pin
379 bottom surface
380 exhaust passage entry
386 first oblique surface
388 second oblique surface From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. An engine braking system comprising:

an engine braking controller responsive to an engine brake command;

an exhaust control path between an engine cylinder and an exhaust discharge path;

a valve element located within the path, the valve element operable between a closed position to close the exhaust control path and a fully open position to open the exhaust control path, the valve element having at least one face exposed to the engine cylinder wherein cylinder pressure during engine braking exerts an opening force on the valve element;

a retainer arranged to be positioned in two operating positions, a first operating position which abuts the valve element to prevent opening of the valve element and a second operating position which clears the valve element to allow opening of the valve element; and an actuator engaged with the retainer and signal-connected to the braking controller to move between a first position and a second position to move the retainer between the first and second operating positions.

2. The system according to claim 1, wherein the retainer is mounted to pivot between the first and second operating positions.

3. The system according to claim 2, wherein the retainer is urged by a spring toward the first operating position.

4. The system according to claim 1, wherein the retainer is urged by a spring toward the first operating position.

5. The system according to claim 1, wherein the retainer has a first inclined surface and the actuator has a second inclined surface, wherein when the second inclined surface is moved from the first position to the second position, the second inclined surface slides on the first inclined surface.

6. The system according to claim 5, wherein the retainer is mounted to pivot between the first and second operating positions.

7. The system according to claim 6, wherein the retainer is urged by a spring toward the first operating position.

8. The system according to claim 1, wherein the at least one face comprises a first surface having a first surface area subject to cylinder pressure when the valve element is in the closed position, and the valve element comprises a second surface set back from the first surface and having a greater surface area than the first surface area, the second surface subject to cylinder pressure when the valve moves toward the open position.

9. The system according to claim 8, wherein the valve element includes a valve spindle, an end of which forms the first surface, and the valve spindle is contiguous with a valve piston, the valve piston slidable within the exhaust control path and forming the second surface, the spindle closing a first valve seat when the valve element is in the closed position, and the piston opening an entry to the exhaust discharge path from the exhaust control path as the valve element moves toward the open position.

10. An engine braking system comprising:

an exhaust control path between an engine cylinder and an exhaust discharge path;

a valve element located within the path, the valve element operable between a closed position to close the exhaust control path and an open position to open the exhaust control path;

a spring urging the valve element toward the closed position;

a retainer arranged to be positioned in two operating positions, a first operating position which prevents opening of the valve element and a second operating position which allows opening of the valve element; and a wedge operable to move between a first position and a second position to move the retainer between the first and second operating positions wherein the at least one face comprises a first surface having a first surface area subject to cylinder pressure when the valve element is in the closed position, and the valve element comprises a second surface set back from the first surface and having a greater surface area than the first surface area, the second surface subject to cylinder pressure when the valve moves toward the open position.

11. The system according to claim 10, wherein the retainer is mounted to pivot between the first and second operating positions.

12. The system according to claim 11, wherein the retainer is urged by a spring toward the first operating position.

13. The system according to claim 10, wherein the retainer is urged by a spring toward the first operating position.

14. The system according to claim 10 wherein the retainer has a first inclined surface and the wedge has a second inclined surface, wherein when the wedge is moved from the first position to the second position, the second inclined surface slides on the first inclined surface.

15. The system according to claim 14, wherein the retainer is mounted to pivot between the first and second operating positions.

16. The system according to claim 15, wherein the retainer is urged by a spring toward the first operating position.

17. The system according to claim 10, wherein the valve element includes a valve spindle, an end of which forms the first surface, and the valve spindle is contiguous with a valve piston, the valve piston slidable within the exhaust control path and forming the second surface, the spindle closing a first valve seat when the valve element is in the closed position, and the piston opening an entry to the exhaust discharge path from the exhaust control path as the valve element moves toward the open position.

* * * * *